United States Patent [19]

Paris

[11] Patent Number: 5,065,533

[45] Date of Patent: Nov. 19, 1991

[54] REAR ENTRY SKI BOOT

[75] Inventor: Jean Paris, Sevrier, France

[73] Assignee: Salomon S. A., Annecy Cedex, France

[21] Appl. No.: 636,729

[22] Filed: Jan. 2, 1991

[30] Foreign Application Priority Data

Jan. 18, 1990 [FR] France ..... 90 00565

[51] Int. Cl.[5] ..... A43B 5/04

[52] U.S. Cl. ..... 36/117; 36/119; 36/120; 36/121

[58] Field of Search ..... 36/117, 118, 119, 120, 36/121

[56] References Cited

U.S. PATENT DOCUMENTS 4,265,034 5/1981 Salomon ..... 36/121
4,765,069 8/1988 Baggio ..... 36/117
5,001,849 3/1991 Bidoia ..... 36/117

FOREIGN PATENT DOCUMENTS 2345097 10/1977 France .
2428413 1/1978 France ..... 36/121
2585930 2/1987 France .

*Primary Examiner*—Paul T. Sewell
*Assistant Examiner*—M. D. Patterson
*Attorney, Agent, or Firm*—Sandler, Greenblum & Bernstein

[57] ABSTRACT

The present invention relates to an alpine ski boot of the rear entry type.

In this tightening boot at least the rear portion of the upper is pivotably mounted around a first horizontal and transverse axis, on a stirrup surrounding the rear of the shell base and which is itself pivotably mounted on the shell base around a second horizontal and transverse axis positioned at a level lower then that of the first axis, the stirrup carries, in its rear central portion, a latching element of the stirrup in the raised position for skiing, this element being positioned in a manner so as to be activated by the tightening lever of the foot, when this lever is pressed against the rear of the upper in the tightening position.

11 Claims, 4 Drawing Sheets

Fig- 6
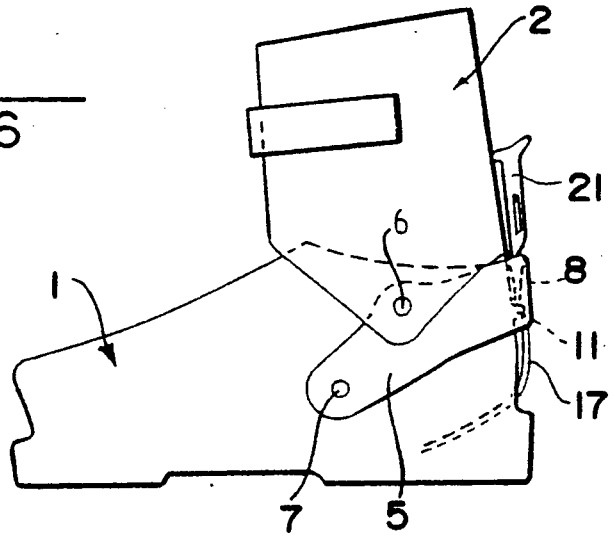
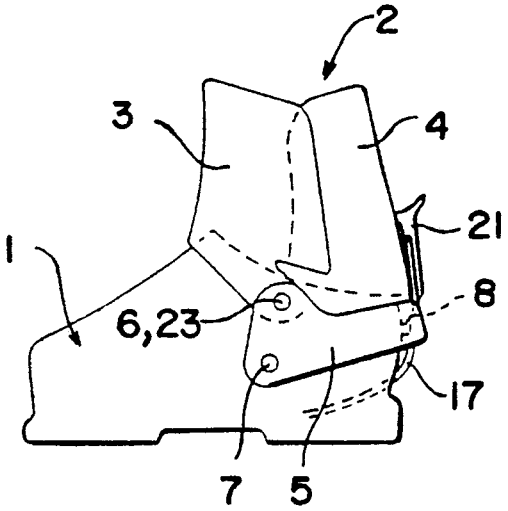
Fig- 7
Fig- 8
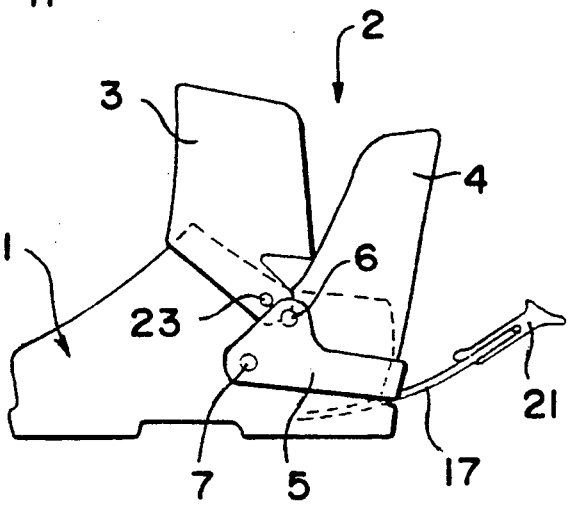

REAR ENTRY SKI BOOT

BACKGROUND OF THE INVENTION

1. Field of the Invention

The present invention relates to a rear entry type ski boot comprising a shell base and an upper, in one or two portions, which is journalled, on the shell base, around a horizontal and transverse axis.

2. Description of Background and Relevant Information

In alpine ski boots of the rear entry type having a journalled upper, the opening axis, i.e., the axis around which the upper pivots, must be positioned relatively close to the ground, for obvious kinematic reasons, so as to facilitate to the maximum the entry of the foot into the boot when the boot is put on. As in most cases, this axis also serves as a flexion axis of the upper, during skiing, the correspondence between this axis and the ankle journalled axis of the skier is not assured. In an attempt to resolve this problem, there has been provided, as will be described for example in French Patent 2,585,930, an alpine ski boot whose upper is constituted of two independent portions, namely, a front cuff and a rear spoiler, which are respectively journalled on the shell base, to their lower portions, around independent transverse pivot axes. The pivot axis of the front cuff is positioned in the zone of the malleoli, while the pivot axis of the rear spoiler is positioned at the rear with respect to the pivot axis of the front cuff. Such a boot is likewise provided with an apparatus for tightening the foot which comprises a front tightening element, longitudinally mounted with respect to the shell base, and a flexible linkage cable connecting the lower portion of this movable element to a tightening lever carried by the rear spoiler of the upper, while passing through the heel of the boot. Consequently, after the skier has tightened the upper of his boot on his lower leg, he pivots the tightening lever frontwardly in order to apply it against the rear spoiler, which causes a traction exerted on the linkage cable, a displacement towards the rear of the movable tightening element, and consequently, the foot is maintained firmly within the boot. Although such a boot facilitates the entry of the foot into the boot when the boot is put on, it has the disadvantage that, during skiing, the front cuff and rear spoiler which are pivotably mounted at their lower portions, on the shell base, around two axes which are distanced from one another, are displaced in the same way as the two movable parallel sides of a deformable parallelogram. Yet, such a displacement results in a translational movement of the front cuff and of the rear spoiler with respect to the leg which results in bothersome friction on the lower leg.

SUMMARY OF THE INVENTION

The present invention relates to improvements to alpine ski boots of the type described above having as an objective to increase the comfort of the skier during skiing while facilitating to the maximum the putting on and taking off of the boot through the rear of the boot.

To this end, the alpine ski boot of the rear entry type according to the invention comprises a shell base, an upper journalled on the shell base, and an apparatus for tightening the foot of the skier within the boot, this tightening apparatus comprising a movable foot tightening element within the shell base, a tightening lever of the foot positioned outside the upper, at the rear thereof, and a flexible linkage element between the tightening lever and the movable tightening element in a manner so as to exert a traction on the flexible linkage element and to press the movable tightening element on the foot of the skier when the tightenting lever is pressed against the rear portion of the upper, in the tightened position. The boot is characterized in that at least the rear portion of the upper is pivotably mounted, around a first horizontal and transverse axis, on a stirrup surrounding the rear of the shell base and which is itself pivotably mounted on the shell base, around a second horizontal and transverse axis positioned at a level lower than that of the first journalled axis of the upper on the stirrup, the stirrup carries, in its rear central portion, a latching element of the stirrup in the raised position for skiing, this element being biased by a return spring in the direction of an unlatching position in which it is spaced from the shell base, and being positioned in a manner so as to be activated by the tightening lever of the foot, when this lever is pressed against the rear of the upper in the foot tightening position, and to be pushed back, by the tightening lever, in the direction of the shell base on which it then supports itself, to assure the latching of the stirrup in the upper position for skiing, the disengagement of the tightening lever causing automatically the passage of the latching element of the stirrup, by the action of the return spring, to an unlatching position and assuring the liberation of the stirrup.

BRIEF DESCRIPTION OF THE DRAWINGS

The invention will now be described with reference to certain non-limiting embodiments, given by way of example only, with reference to the annexed drawings in which:

FIG. 6 is an elevational view of one embodiment of a boot having an upper journalled at a single portion;

FIG. 7 is an elevational view of an alternative embodiment of a boot having an upper in two portions, having a front cuff journalled on the shell base, in the skiing position; and FIG. 8 is an elevational view of the ski boot of FIG. 7, the upper being shown opened for insertion and removal of the foot from the boot.

DESCRIPTION OF PREFERRED EMBODIMENTS

Figure 1:
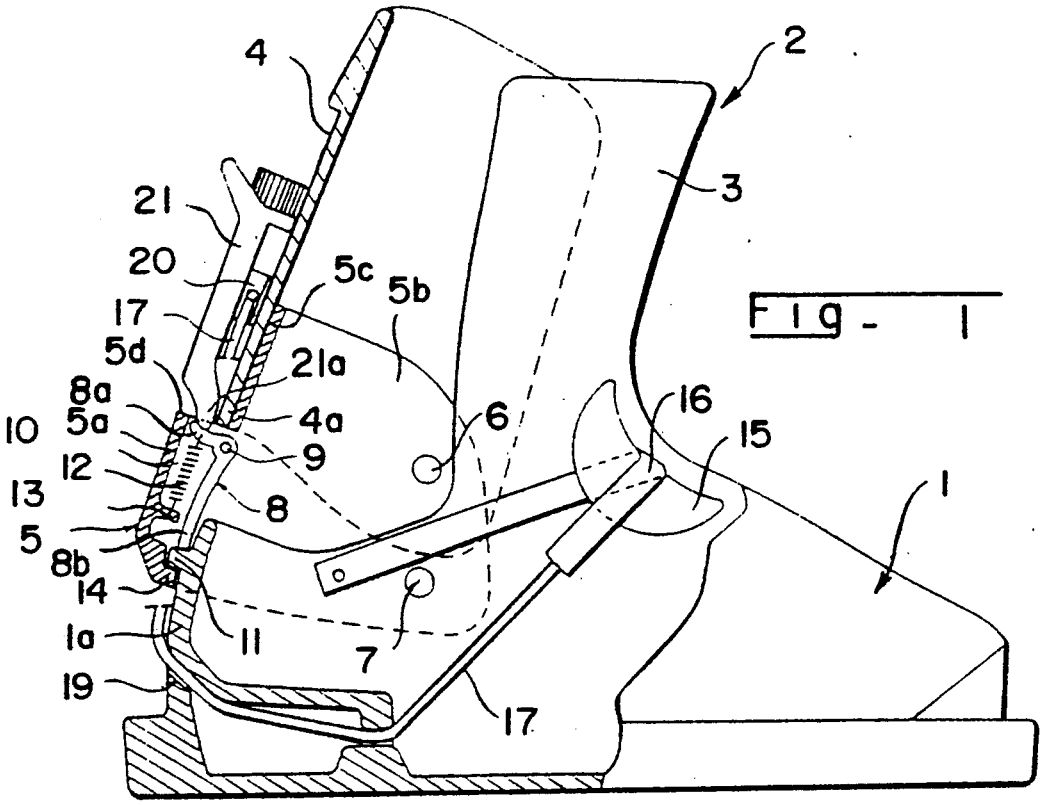
FIG. 1 is an elevational view, partially in vertical and longitudinal cross section, of a rear entry alpine ski boot according to the invention, whose upper has two portions, front and rear, in a normal position of skiing.

The alpine ski boot according to the invention which is shown in FIGS. 1–4 comprises a rigid shell base 1 and an upper 2 which, in this non-limiting embodiment, is constituted by two portions. The upper 2 comprises a front cuff 3 which extends shell base 1 upwardly, by means of a deformable zone, and a rear spoiler 4, the front cuff 3 and rear spoiler 4 being tightened around the lower leg of the skier, during skiing, by appropriate closure means which are not shown.

Rear spoiler 4 of upper 2 is mounted on a stirrup 5 which surrounds the rear of shell base 1. This stirrup 5 comprises a posterior and lower core 5*a*, which is thick, and which is positioned at the rear of the rear wall 1*a* of shell base 1, and two thin lateral wings 5*b*, which extend frontwardly from the rear and lower core 5*a*. These lateral wings 5*b* have, in their front portions, a height greater than that of the lower core 5*a* and they are connected to one another by a rear and upper core 5*c*, which is off set towards the front with respect to the lower core 5*a*, a step 5*d* thus being formed between the two cores 5*a* and 5*c*. The upper portion of the stirrup 5, comprising in particular upper core 5*c*, is engaged within the lower portion of rearspoiler 4 and the rear portion of the lower edge 4*a* of spoiler 4 is supported on step 5*d*.

The rear spoiler 4 is pivotably mounted on stirrup 5 around a horizontal and transverse axis formed by two coaxial projections 6 assuring the linkage between the rear spoiler and stirrup 5 and constituting pivots for the rear spoiler 4. Furthermore, stirrup 5 is in turn pivotably mounted on shell base 1 around a horizontal and transverse axis formed by transversely aligned projections 7.

Figure 2:
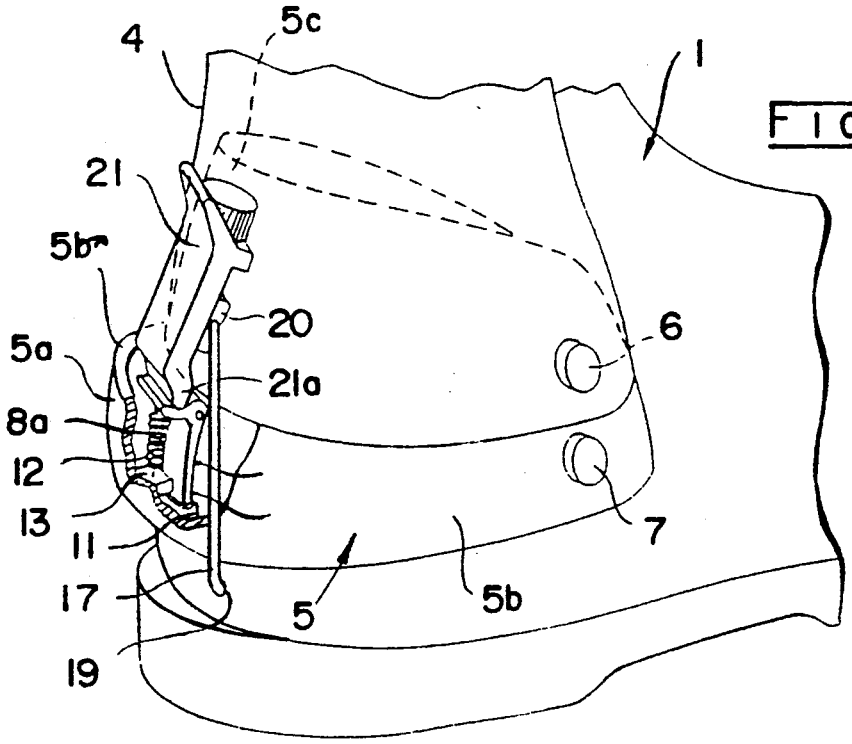
FIG. 2 is a partial perspective view of the rear and lower portion of the boot of FIG. 1.

In the skiing position, as is shown in FIGS. 1 and 2, the pivot axis of rear spoiler 4 on stirrup 5 formed by projections 6 is positioned at a level above that of the pivot axis of stirrup 5 on shell base 1, formed by projections 7, and the two pivot axes 6 and 7 are situated substantially in the same vertical and transverse plane.

Stirrup 5 carries a latching ratchet 8 which is journalled on stirrup 5 around a horizontal and transverse axis 9 and is positioned in a central recess 10 formed in the internal surface of the lower core 5*a* of substantial thickness, and which is opened upwardly and downwardly. This ratchet 8 is adapted to assure the maintenance of stirrup 5 in the upper position, during skiing, as is shown in FIGS. 1 and 2. Journal axis 9 of ratchet 8 extends across the upper portion of recess 10 and ratchet 8, substantially in the form of an inverted L, comprises two arms extending from journal axis 9, namely an upper arm 8*a* which is relatively short, extending towards the rear from journal axis 9, and a lower arm 8*b* which is longer than the upper arm 8*a* and extends downwardly. This lower arm 8*b* is adapted to be supported, at its lower end, on the shell base 1 and more particularly on an abutment 11 which is constituted by an external bump provided on the upper portion of the rear wall la of shell base 1. Ratchet 8 is biased in the clockwise direction by a spring 12 of any appropriate type. Spring 12 can in particular be a compression spring which is supported, at its upper end, under the upper arm 8*a* of ratchet 8, and at its lower end, on an internal projection 13 provided in recess 10 of core 5*a* of stirrup 5. Spring 12 thus constantly biases upper arm 8*a* of ratchet 8 upwardly.

The angular displacement of stirrup 5 around its pivot axis 7 is limited in the upward sense by a lip 14 constituting a lower edge of the rear core 5*a* of stirrup 5 and extends in the direction of rear wall 1*a* of shell base 1. This lip is pressed under bump 11 when stirrup 5 pivots upwardly, thus limiting the amplitude of angular movement of stirrup 5 which, as a result, does not participate in the flexion of the upper.

The ski boot according to the invention is likewise provided with a foot tightening apparatus which can be of any known type, and particularly of the type which is described in French Patent 2,345,097 of Applicant, the disclosure of which is hereby incorporated by reference thereto. This tightening apparatus can be an instep holddown apparatus, comprising, in the interior of shell base 1, a movable tightening element constituted by a pressure distribution plate 15, which caps the instep of the skier and which is movably mounted in a manner so as to be able to be pulled downwardly and towards the rear when the skier desires to tighten his foot within the boot. A tightening strap 16 passes over pressure distribution plate 15 which is applied on the instep of the skier, the strap being connected to a cable 17 extending towards the rear. Cable 17 goes outside of shell base 1 and extends through a hole 19 provided, for example, in the rear wall 1*a* of the shell base. According to an alternative embodiment, cable 17 could extend through a hole which is bored in the lateral wall of the shell base. Cable 17 then climbs up into stirrup 5, between its rear core 5*a* and the posterior wall 1*a* of the shell base, and it is hooked, at its upper end, to an apparatus for adjusting the tension apparatus 20 of cable 17, this apparatus 20 being carried by a tightening lever 21.

During skiing, the tightening lever 21 extends along the length of the wall of rear spoiler 4 against which it is pressed as a result of the tension of cable 17. Furthermore, tightening lever 21 is supported, at its lower end 21*a*, on the upper arm 8*a* of ratchet 8. Consequently, under the effect of the tension of cable 17, tightening lever 21 is biased downwardly, it exerts a downward force on the upper arm 8*a* of ratchet 8 and it thus maintains ratchet 8 in the latched position as is shown in FIGS. 1 and 2, against the action of return spring 12.

From the preceding description, it is seen that in the skiing position, stirrup 5 is maintained latched in the upper position by virtue of lower arm 8*b* of ratchet 8 being supported on abutment 11 of rear wall 1*a* of shell base 1, under the effect of the foot tightening lever 21. In this position pivot axis 6 of rear spoiler 4 on stirrup 5 is positioned substantially vertically to pivot axis 7, above it, in the zone of the malleoli of the skier, and upper 2 can flex in its entirety around pivot axis 6 which is almost aligned with that of the ankle of the skier. This flexing is made possible by the fact that front cuff 3 which forms a single piece with shell base 1 is connected to the shell base in the zone of the instep by a relatively flexible zone Rear spoiler 4 is retained towards the rear by means of its lower and rear edge 4*a* being supported on the upper step 5*d* of stirrup 5 which is itself blocked. Means can, if desired, be provided to adjust the position of rear spoiler 4 with respect to stirrup 5 so as to vary the inclination or advancement of the upper assembly 2 with respect to the horizontal plane.

Furthermore, in the unlatched position, stirrup 5 is no longer blocked, and cable 17 no longer exerts tension by blocking the flexion fold of the instep and the tendon lifter of the big toe, walking with the ski boot is thus facilitated without it being necessary to unlatch the closure means of the upper.

Figure 3:
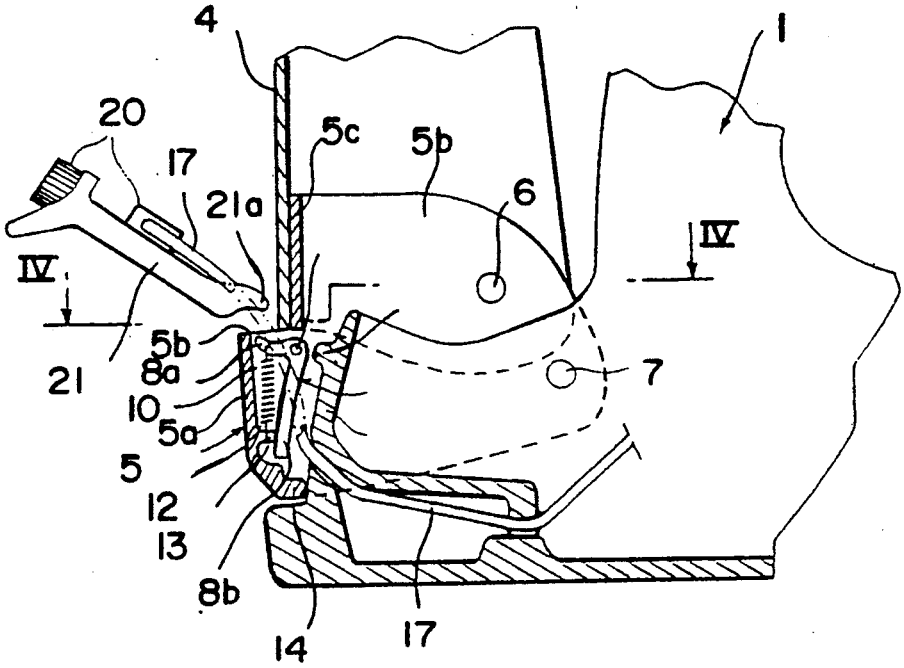
FIG. 3 is a vertical and longitudinal cross sectional view of the rear and lower portion of the boot, the stirrup being shown in the lowered position for insertion and removal of the foot from the boot.
Figure 4:
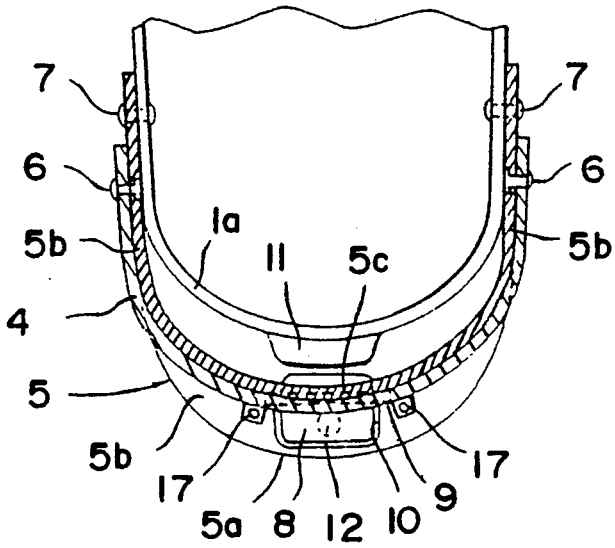
FIG. 4 is a horizontal, cross sectional view along line IV—IV of FIG. 3.

When the skier wishes to remove his foot from the boot, it suffices to rock the foot tightening lever 21 towards the rear, as is shown in FIG. 3, in a manner so as to distance it from the rear spoiler 4. This rocking of tightening lever 21 has two effects, namely, first the suppression of the traction exerted on cable 17 such that as the pressure distribution plate 15 is not applied under pressure on the instep of the skier, and, secondly, the termination of the action of lever 21 on unlatching ratchet 8. As a result, ratchet 8 pivots automatically in the clockwise direction, under the effect of return spring 12, and it is pressed against the lower core 5*a*, as is shown in FIG. 3. As a result of this movement, the lower end of lower arm 8*b* of rachet 8 escapes abutment 11 such that stirrup 5 is freed and it can pivot downwardly around axis 7. The final lower position reached by stirrup 5 is shown in FIG. 3. As a result of this movement, pivot axis 6 of rear spoiler 4 on stirrup 5 is offset towards the rear and downwardly, with respect to the position which it occupies in the latched position and is shown by dashes in FIG. 3, which facilitates the removal of the boot.

If the skier wishes to put his boot back on, he replaces the tightening lever 21, stirrup 5 being in the lower position, in the tightening position in which it is applied against rear spoiler 4. Tightening lever 21 is then supported, by its lower end 21*a*, on the upper arm 8*a* of ratchet 8, without however, exerting a force on this arm 8*a*, at this moment, by virtue of the fact that cable 17 is released. The skier then closes the upper 2 by tightening the front cuff 3 and rear spoiler 4 around his lower leg. The skier flexes his lower leg frontwardly such that rear spoiler 4 which rocks frontwardly, moves with it stirrup 5 which then pivots in a clockwise direction around axis 7. In the course of this movement the lower core 5*a* of stirrup 5 is displaced upwardly, as well as the rachet 8 whose lower arm 8*b* slides along the length of abutment 11 until its lower end arrives above this abutment. At this moment, rachet 8 pivots in the counterclockwise direction under the force exerted by tightening lever 21 which is then biased downwardly by cable 17 which is under tension and rachet 8 is supported on abutment 11 by its lower arm 8*b*. Stirrup 5 is thus automatically latched in the upper position corresponding to skiing.

According to an alternative embodiment, the sequence of successive operations performed for putting on the boot can be slightly different. In effect, the skier can first close upper 2 around his lower leg, after which he flexes his lower leg frontwardly, which has the effect of bringing rachet 8 up to the height of its latching position on shell base 1. Ratchet 8 remains, however, in contact with lower core 5*a*, under the effect of spring 12. The skier then latches the tightening apparatus of the foot by pulling on tightening lever 21 to press it against rear spoiler 4. This lever 21 is then supported through its lower end 21*a* on upper 8*a* of ratchet 8, which serves to move this rachet to the latching position in which it is in support, through its lower arm 8*b* on abutment 11.

Figure 5:
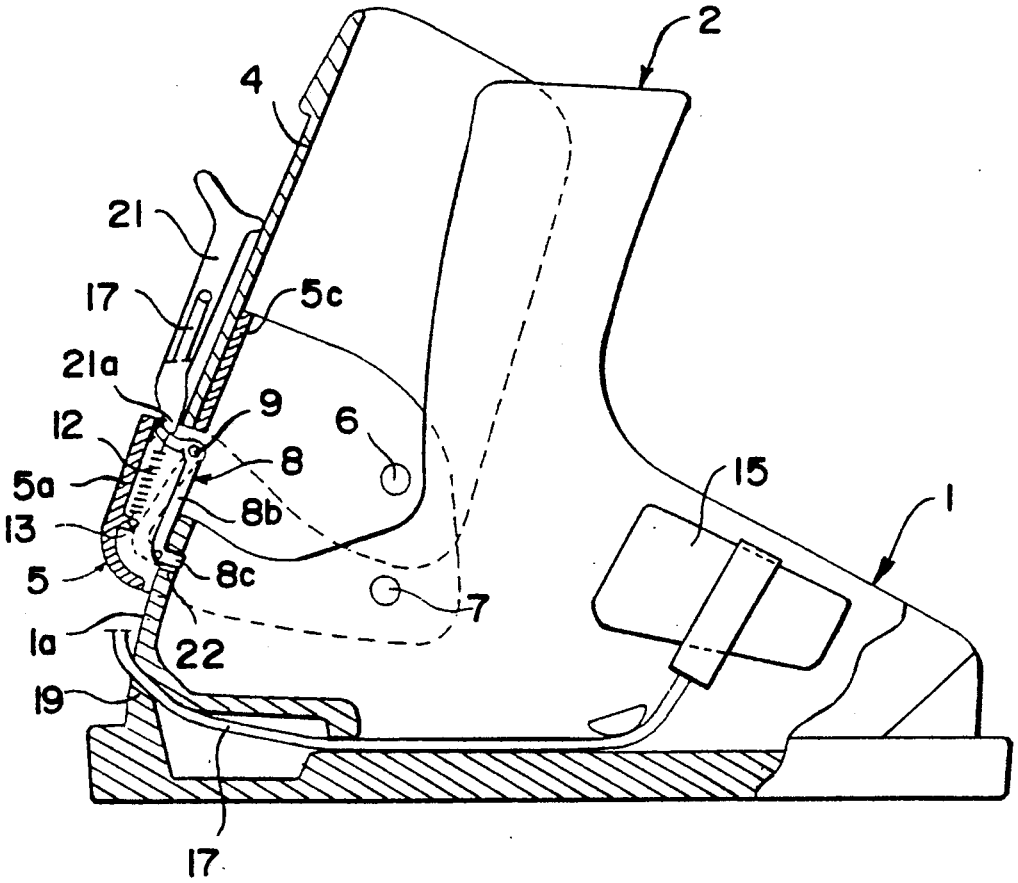
FIG. 5 is a vertical and longitudinal cross-sectional view of an alternative embodiment of the latching apparatus of the stirrup in the raised position.

In the embodiment shown in FIG. 5, the latching ratchet 8 has, at the end of its lower arm 8*b*, a tooth 8*c* which is curved in the direction of the rear wall 1*a* of shell base 1. This tooth 8*c* is adapted to engage in a hole 22 provided in the rear wall 1*a* in the latching position. Tooth 8*c* likewise assures the retention of stirrup 5 in the two directions, i.e., upwardly and downwardly, to block the angular movement of this stirrup. Furthermore, the foot tightening apparatus comprises, in this case, a pressure distribution plate 15 which is pressed against the top of the foot and which is pulled downwardly by strap 16 and cable 17.

FIG. 6 illustrates an alpine ski boot according to the invention of the type comprising an upper 2 made up of one single element. This upper 2 is journalled, as has previously been described, on stirrup 5, around pivot axis 6 which, in this case, is, however, offset towards the rear, in the skiing position, with respect to pivot axis 7 of stirrup 5 on shell base 1.

FIGS. 7 and 8 illustrate another embodiment of an alpine ski boot in which upper 2 is formed out of two portions, namely, a front cuff 3 and a rear spoiler 4, but front cuff 3 is distinct from shell base 1 and it is journalled, at its lower portion, on the shell base, around an independent horizontal and transverse axis 23. As for rear spoiler 4, it is pivotably mounted on the pivoting stirrup 5, around axes 6, as has previously been described. The two axis 6 and 23 are aligned in the skiing position (FIG. 7) and instead axis 6 is offset towards the rear and downwardly with respect to axis 23 when the boot is put on and taken off. (FIG. 8)

This application is based upon French Application Serial No. 90 00565 filed Jan. 18, 1990.

Finally, although the invention has been described with reference to particular means, materials and embodiments, it is to be understood that the invention is not limited to particulars disclosed and extends to all equivalents within the scope of the claims.

What is claimed is:

1. Alpine ski boot of the rear entry type comprising a shell base 1 and an upper 2 journalled on the shell base, and an apparatus for tightening the foot of the skier located within the interior of the boot, said tightening apparatus comprising a movable foot tightening element within the shell base, a foot tightening lever positioned on the outside of the upper, at the rear of the same, and a flexible linkage element between the tightening lever and the movable tightening element in a manner so as to exert a traction on the flexible linkage element and to press the movable tightening element on the foot of the skier when the foot tightening lever is pressed against the rear portion of the upper, in a tightening position, and wherein at least the rear portion is the upper of pivotably mounted around a first horizontal and transverse axis, on a stirrup surrounding the rear of the shell base and which is itself pivotably mounted on this shell base, around a second horizontal and transverse axis positioned at the lower level of that of the first journal axis of the upper on the stirrup, the stirrup carries, at its rear central portion, an element for latching the stirrup in the upper position for skiing, this element being biased by a return spring in the direction of the unlatching position in which it is distanced from the shell base, and being adapted to be activated by the foot tightening lever, when this lever is pressed against the rear of the upper in the foot tightening position, and to be pushed back, by the tightening lever, in the direction of the shell base on which it is then supported to ensure the latching of the stirrup in the upper position for skiing, the disengagement of the tightening lever automatically causing the movement of the latching element of the stirrup, under the effect of its return spring, into the unlatching position and ensuring the freeing of the stirrup.

2. The alpine ski boot as defined by claim 1 wherein the latching element is constituted by a ratchet which is journalled on the rear portion of the stirrup, around a horizontal and transverse axis.

3. The alpine ski boot as defined by claim 2 wherein the latching ratchet is positioned in a central recess formed in the internal surface of the rear portion of the stirrup.

4. The alpine ski boot as defined by claim 3 wherein the journal axis of the latching ratchet extends across the upper portion of the recess which is open upwardly and downwardly and the latching ratchet, substantially in the form of an inverted L, comprises two arms extending from the journal axis, namely an upper arm, extending towards the rear from the journal axis, on which is supported, in the tightening position, the lower end of the tightening lever and a lower arm extending downwardly and which is supported, at its lower end, on the shell base in the latching position.

5. The alpine ski boot as defined by claim 4 wherein the return spring of the latching ratchet is a compression spring which is supported, at its upper end, under the upper arm of the ratchet and, at its lower end, on the internal projection provided in the recess of the rear portion of the stirrup.

6. The alpine ski boot as defined claim 4 wherein the rear wall of the shell base carries an external bump constituting an abutment for the lower end of the lower arm and of the latching ratchet.

7. The alpine ski boot as defined by claim 4 wherein the latching ratchet has, at its lower arm, a tooth which is curved in a direction of the rear wall of the shell base and this tooth engages in a hole provided in the rear wall, in the latching position.

8. The alpine ski boot as defined by claim 1 wherein the flexible linkage element is constituted by a cable passing between the rear portion of the stirrup and the rear wall of the shell base.

9. The alpine ski boot as defined by claim 3 wherein the stirrup comprises a rear and lower core which is positioned at the rear of the rear wall of the shell base and in the internal surface of which is provided the recess and in which is positioned the latching ratchet, two lateral wings extending toward the front from the rear and lower cones, these lateral wings having, in their front portion, a height greater than that of the lower cone and being connected between them by a rear and upper cone which is offset toward the front with respect to the lower cone, a step being thus formed between the cones, the upper portion of the stirrup, comprising in particular the upper cone, is engaged within the lower portion of the rear spoiler of the upper and the rear portion of the lower edge of this rear portion is supported on the steps.

10. The alpine ski boot as defined by claim 1 wherein the movable tightening element of the tightening apparatus is a pressure distribution plate which caps the instep of the skier.

11. The alpine ski boot as defined by claim 1 wherein the movable tightening element of the tightening apparatus is a pressure distribution plate pressed against the top of the foot of the skier.

* * * * *